United States Patent [19]

Stalzer

[11] 4,275,535

[45] Jun. 30, 1981

[54] CONSTRUCTION SURVEY LATH-STAKE BASE

[76] Inventor: Kenneth R. Stalzer, Naperville, Ill.

[21] Appl. No.: 87,785

[22] Filed: Oct. 24, 1979

[51] Int. Cl.[3] ..... E02D 27/42

[52] U.S. Cl. ..... 52/100; 52/103; 52/155; 52/165; 116/209; 248/519

[58] Field of Search ..... 52/103, 100, 176, 165, 52/155; 116/209; 248/519, 523, 156, 530

[56] References Cited

U.S. PATENT DOCUMENTS

| | | | |
|---|---|---|---|
| 213,932 | 4/1879 | Powell | 52/155 |
| 3,654,965 | 4/1972 | Gramain | 52/100 X |
| 3,688,454 | 9/1972 | Wolfcarius | 52/103 |
| 3,724,145 | 4/1973 | Daniel | 52/165 X |
| 3,809,346 | 5/1974 | Jackson | 248/156 |
| 3,945,163 | 3/1976 | Nagler et al. | 52/100 X |
| 4,004,383 | 1/1977 | Watanabe | 52/165 X |

*Primary Examiner*—Alfred C. Perham
*Attorney, Agent, or Firm*—Brady, O'Boyle & Gates

[57] ABSTRACT

A base member having apertures formed therethrough for accommodating a lath and a stake employed for locating lines, grades and distance in construction survey, the base member also having a bore for accommodating a spike for securing the base to hard or frozen ground.

7 Claims, 5 Drawing Figures

CONSTRUCTION SURVEY LATH-STAKE BASE

BACKGROUND OF THE INVENTION

In construction surveying in connection with the preliminary preparations for the actual construction of highways, railroads, bridges, buildings, and the like, it is conventional to employ laths and stakes for locating and indicating lines, grades, and distance. The laths are usually $4' \times \frac{3}{8}'' \times 1''$ or $1\frac{1}{2}''$, and the stakes, $18'' \times \frac{3}{4}'' \times 1\frac{1}{2}''$, and each member having a pointed end to facilitate driving the member into the ground. While the use of these laths and stakes presents no problems during relatively warm weather when the ground is soft, considerable difficulties have been encountered during cold weather when the ground is frozen since it is most difficult, if not impossible, to drive the pointed end of the lath or stake into the frozen ground.

After considerable research and experimentation, the base of the present invention has been devised for accommodating the lath and stake, and is constructed and arranged to support the lath and stake on frozen ground. The base of the present invention comprises, essentially, a member having apertures formed therethrough for accommodating and supporting the lath and/or stake in a vertical position. A bore is also provided in the base for receiving a ground penetrating spike, whereby the base and associated lath and stake may be supported on frozen ground. It is contemplated that the base may be molded from plastic having removable portions initially covering one end of each of the apertures. In use, the covers are selectively removed for accommodating either the lath or stake, or both. In the event that only the lath is used, the cover on the stake receiving aperture remains in place and can be used as a surface upon which the line and distance readings can be recorded, which heretofore have been noted on the top surface of the stake.

DESCRIPTION OF THE PREFERRED EMBODIMENT

Figure 1:
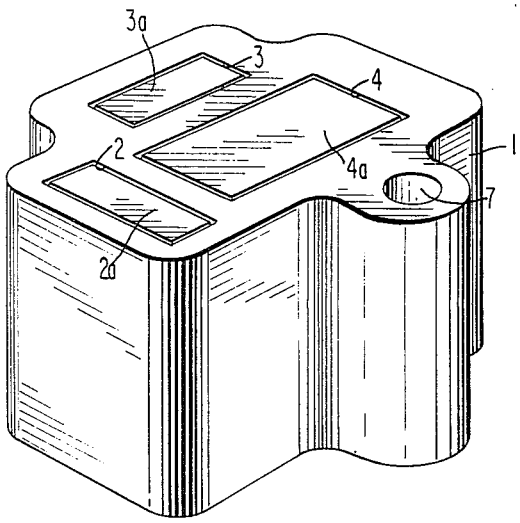
FIG. 1 is a perspective view of the lath-stake base of the present invention.
Figure 2:
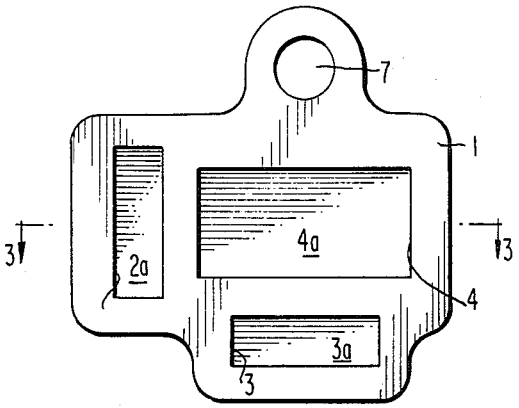
FIG. 2 is a top plan view of the base.
Figure 3:
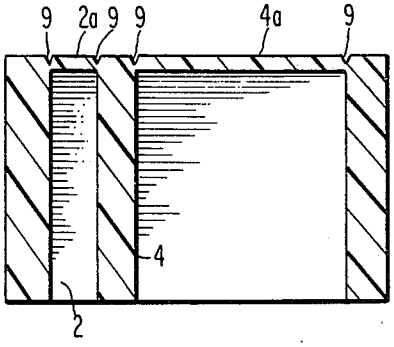
FIG. 3 is a view taken along line 3—3 of FIG. 2.
Figure 5:
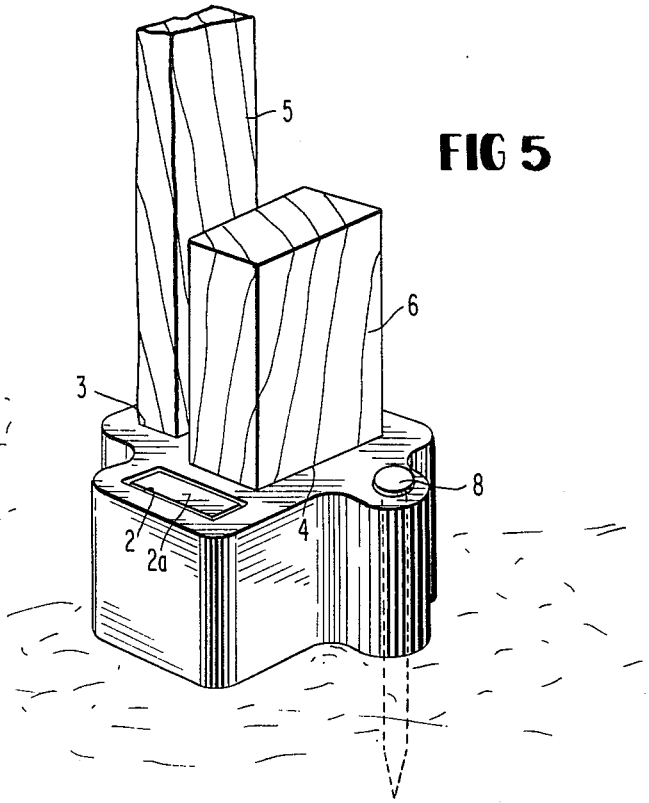
FIG. 5 is a perspective view of the base supporting both a lath and a stake in frozen ground.

Referring to the drawings, and more particularly to FIGS. 1, 3 and 5, the lath-stake base of the present invention comprises a molded plastic block 1 having rectangular apertures 2, 3 and 4 formed therethrough. The rectangular apertures 2 and 3 are adapted to receive a lath 5 and the rectangular aperture 4 is adpated to receive a stake 6. A bore 7 is also formed in the base member for receiving a spike 8 whereby the base may be secured to hard or frozen ground.

In molding the base member, the top surface is formed with a thin layer of plastic to provide covers 2*a*, 3*a* and 4*a* for the lath and stake accommodating apertures 2, 3, 4, respectively. A score line 9 is formed around the perimeter of these apertures so that the covers can be easily punched out or otherwise removed from their respective apertures.

Figure 4:
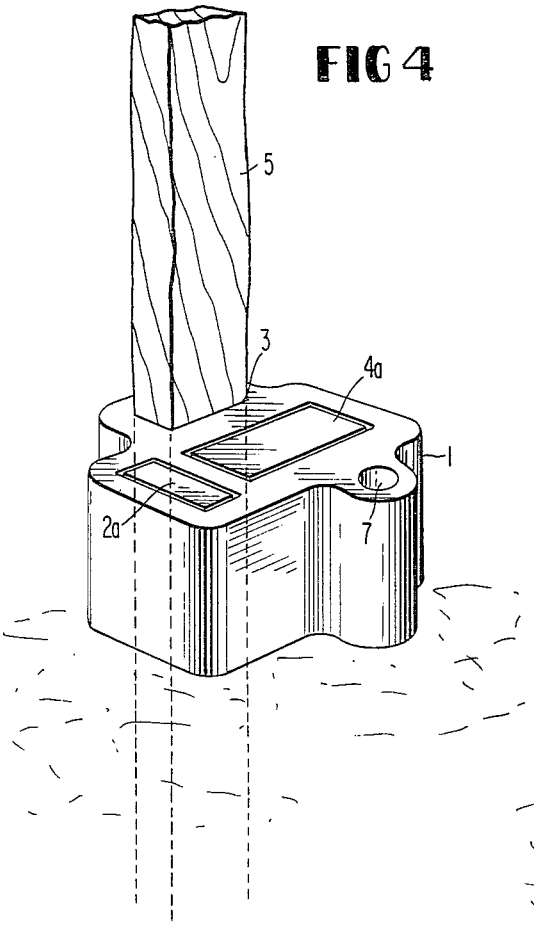
FIG. 4 is a perspective view of the base accommodating a lath driven into soft ground.

In use, assuming that the particular construction survey is taking place when the ground is soft, and the use of only the lath 5 is required, as shown in FIG. 4, the cover 3*a* is removed and the stake 5 is inserted through the ground. In this arrangement, the covers 2*a* and 4*a* would remain in place and can be used as a writing surface upon which the line and distance readings can be recorded.

If the survey is taking place when the ground is hard or frozen, the spike 8 is inserted into the bore 7 and driven into the ground, the lath 5 and/or stake 6, having flush-cut ends, can then be inserted into the apertures 3 and 4 after the covers 3*a* and 4*a* have been removed. By this construction and arrangement, the flush-cut ends of the lath and stake engage the top surface of the ground and are supported in a vertical position by the base 1 which is secured to the ground by the spike 8, thereby precluding the necessity of driving the ends of the lath and stake into the ground.

By providing two lath apertures 2 and 3 oriented 90° from each other, it will be readily apparent to those skilled in the art that instead of inserting a lath 5 in aperture 3, a lath can be inserted into aperture 2 to permit the use of a different surface axis of the stake 6.

From the above description, it will be seen that the lath stake base of the present invention provides a two-fold function; namely, when used on soft ground, the lath can be driven through the base into the ground and the top surface of the base can be used to record the line and distance readings which heretofore were recorded on the top surface of the stake, and when used on hard or frozen ground, the base provides a support for holding the lath and/or stake in a vertical position, while only the spike 8 penetrates the ground.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A construction survey lath-stake base comprising a block having a top surface and a bottom surface, a plurality of vertically extending apertures formed through said block, a construction survey lath adapted to be inserted into one of said apertures, a construction survey stake adapted to be inserted into another of said apertures, the bottom surface of the block being supported on the surface of the ground to be surveyed, the top surface of the block being of an extent to provide a writing surface upon which line and distance readings may be recorded, and means securing said block to the ground.

2. A construction survey lath-stake base according to claim 1, wherein the means for securing the block to the ground comprises the end portion of the lath extending through the block and penetrating the ground.

3. A construction survey lath-stake base according to claim 1, wherein the means for securing the block to the ground comprises, a bore extending through said block, and a spike extending through said bore and penetrating the ground.

4. A construction survey lath-stake base according to claim 1, wherein the apertures are rectangular in cross-section.

5. A construction survey lath-stake base according to claim 1, wherein three apertures are formed through said block, two of said apertures being configured to receive a lath, and the remaining aperture configured to receive a stake, one of said lath receiving apertures being oriented 90° from the other lath receiving aperture to thereby permit the use of a different surface axis of the stake.

6. A construction survey lath-stake base according to claim 1, wherein a pair of apertures are formed through said block, said lath being inserted into one of said apertures, a removable cover provided on one end of the other aperture, said removable cover forming the top surface providing a writing surface upon which line and distance readings are recorded.

7. A construction survey lath-stake base according to claim 1, wherein the block is molded from plastic, a thin layer of plastic being formed on the top surface of said block covering the lath receiving aperture and the stake receiving aperture, a score line formed around the perimeter of said aperture, whereby the portion of the plastic layer covering the apertures can be selectively removed to permit the lath and stake to be inserted into their respective aperture.

* * * * *